US012145762B2

(12) United States Patent
Cassoli et al.

(10) Patent No.: US 12,145,762 B2
(45) Date of Patent: Nov. 19, 2024

(54) CAPSULE-SEALING SYSTEM WITH IMPROVED SEALING HEAD

(71) Applicant: ECOCAP'S S.r.l., Casalecchio di Reno (IT)

(72) Inventors: Jacopo Cassoli, Casalecchio di Reno (IT); Nicola Giuliani, Valsamoggia (IT); Federico Catozzi, Ferrara (IT)

(73) Assignee: ECOCAP'S S.r.l., Casalecchio di Reno (IT)

( * ) Notice: Subject to any disclaimer, the term of this patent is extended or adjusted under 35 U.S.C. 154(b) by 7 days.

(21) Appl. No.: 17/643,981

(22) Filed: Dec. 13, 2021

(65) Prior Publication Data

US 2022/0185513 A1 Jun. 16, 2022

(30) Foreign Application Priority Data

Dec. 15, 2020 (IT) ..... 102020000030905

(51) Int. Cl.
*B65B 7/28* (2006.01)

(52) U.S. Cl.
CPC ..... *B65B 7/2878* (2013.01); *B65B 7/2807* (2013.01)

(58) Field of Classification Search
CPC ..... B65B 7/2878; B65B 7/2807
USPC ..... 53/329.2
See application file for complete search history.

(56) References Cited

U.S. PATENT DOCUMENTS 5,647,497 A * 7/1997 Labbe ..... B65D 17/4012 220/276
6,508,047 B1 * 1/2003 Groppi ..... B65B 17/025 294/87.2
6,708,748 B1 * 3/2004 Kronseder ..... B65D 51/185 53/129.1
7,168,223 B2 * 1/2007 Caffeo ..... B65B 7/2878 53/329.2
2005/0160698 A1 7/2005 Caffeo

FOREIGN PATENT DOCUMENTS

EP 1070669 A1 1/2001

OTHER PUBLICATIONS

Ministero Dello Sviluppo Economico, Search Report and Written Opinion for Italian Patent Application No. 202000030905, Aug. 27, 2021, 6 pages.

* cited by examiner

*Primary Examiner* — Robert F Long
*Assistant Examiner* — Xavier A Madison
(74) *Attorney, Agent, or Firm* — Stetina Brunda Garred & Brucker

(57) ABSTRACT

According to the present disclosure, a system for capsule sealing using an improved sealing head for applying a top to a can is contemplated. The improved sealing head is contemplated as being capable of producing a sealed can having greater adhesion and strength in at least one area of the can edge, and a weaker adhesion in the remaining area of the can edge, in order to simplify opening and to reduce any requirements for the use of non-metallic adhesives.

4 Claims, 2 Drawing Sheets

CAPSULE-SEALING SYSTEM WITH IMPROVED SEALING HEAD

CROSS-REFERENCE TO RELATED APPLICATIONS

This application claims priority to Italian Patent Application No. 102020000030905 filed on Dec. 15, 2020, the entire disclosure of which is incorporated herein by reference.

STATEMENT RE: FEDERALLY SPONSORED RESEARCH/DEVELOPMENT

Not Applicable

BACKGROUND

The present invention relates to a capsule-sealing machine having an improved sealing head for applying a covering capsule or covering capsule to the top surfaces of cans, and to an improved sealing head and can having a respective covering capsule.

In the present document, the terms capsule and covering capsule are equivalent and refer to a very thin metal capsule, typically made of aluminium alloy, which forms the covering or capsule for the can to be packaged.

The field of application of the invention is the industrial field of production and/or processing of cans, typically cylindrical in shape made of thin aluminium, which can contain liquids of various types, such as for example soft drinks, beer, rather than food and similar immediately available through an opening generally closed by a removable tab positioned radially on a top surface of the can.

For hygienic reasons, it has been in use for some time to cover the entire upper surface of the cans, in particular those areas where the mouth of a user who wishes to drink the contents of the can from its opening after removing the tab, comes into contact with covering capsule.

A technology known in the state of art is disclosed in Patent Document No. US2005160698, wherein a capsule-sealing machine that applies capsules to cans is illustrated and described. In a capsule-sealing station of the machine, the cans, moved by a rotating drum, are positioned substantially coaxial to a pusher, which supports them inferiorly, to a capsule to be applied and to a sealing head suitable for fixing the capsule to be applied which is interposed between the upper part of the can and the sealing head. The sealing head is radially provided with a plurality of circular sectors positioned with one of their lower ends shaped around on a circumference of the upper edge of the can to be covered when the can with the capsule interposed approaches the head during processing. In addition, the sealing head is provided with elastic means of equal stiffness coupled with the individual circular sectors, typically opposing elastic springs, for the axial movement opposed by the circular sectors when they come into contact with the capsule and the can edge area. More specifically, when the can enters into the processing station, the machine drive the pusher which pushes a can from the bottom upwards in the direction of the sealing head, whose circular sectors are previously heated to a given temperature by means of electric resistances inside the same head in order to favour a local fusion of the capsule to be applied on a can edge contour. When the conformed lower parts of the circular sectors come into contact with the covering capsule and the latter with an upper surface of the can respectively, the opposing springs generate a coupling tension which, together with the given temperature, generates a surface sealing of the capsule on an area around the edges of the can. The resulting seal of the capsule occurs substantially uniformly along its entire extent, causing the capsule to adhere uniformly to a circumference of the entire edge of the can and covering the entire top surface of the can.

The applicant has found and solved, in the field of can capsule-sealing machines, the need to obtain cans equipped with a covering capsule that is difficult to separate completely from the can itself, with the risk that the same is dispersed into the environment separately from the can when the covering capsule is manually removed from its upper seat in order to free access to the tab so that the can be used and emptied of its contents.

A limitation of the capsule-sealing machine known with respect to the above technical problem is that it applies a seal of the same adhesion force and tightness around the entire perimeter of the edge of the covered can, thus providing the same tearing or peeling strength of the covering capsule around the entire perimeter of the can edge. Easily, a user of the can, wishing to access its contents, due to carelessness and/or distraction, may apply a force to a protruding edge of the can itself which is significantly greater than that required to free the tab area and its adjacent upper access edge from the can opening, thus completely separating the capsule from the can itself, both of which are made of metal and typically of the same material, i.e. aluminium alloy, in order to be recycled together to protect the environment. This can be particularly the case for a capsule uniformly sealed at the edges as taught in US2005160698, and even more so if the seal is considerably strong and the user is taken by the desire to quickly make use of the contents of the can, making the probability of tearing it completely off the top edge and dispersing the capsule into the environment randomly and/or separately from the can itself high.

BRIEF SUMMARY

It is an object of the present invention to solve the drawbacks of the prior art mentioned above and to disclose a capsule-sealing machine having an improved type of sealing head for applying a covering capsule to the top surfaces of cans and related improved sealing head and can equipped with the respective covering capsule, capable of achieving substantial recyclability of the can together with the respective covering capsule.

An object of the invention is to realise a sealing of the capsule having greater adhesion and strength in at least an area of the can edge and a weaker adhesion in the remaining area(s) of the can edge where the opening of the can is located. Therefore, the greater adhesion area is away from the edge adjacent to the opening.

An object is to achieve head refinement in a substantially simple, cheap, and effective manner.

An object is to avoid possible contamination of the surfaces of the can with non-metallic materials, such as adhesives placed on the edge of the can to hold the covering capsule with greater strength and adhesion.

In order to achieve these purposes, it is an object of the present invention to provide a capsule-sealing machine having an improved type of sealing head for applying a covering capsule to the top surfaces of cans, and an improved sealing head and can having a covering capsule thereon, according to the features of the attached claims.

The invention relates in the first instance to a sealing head of a capsule-sealing machine as in the preamble of claim 1. The sealing head is characterised by comprising elastic means of different stiffness coupling to the circular sectors and, more in detail, elastic means of higher stiffness coupling to circular sectors positioned at distal points to i.e. in the absence of an edge of the can adjacent to the opening of the can, of lower stiffness when coupling to circular sectors positioned at points proximal to i.e. in the presence of the edge of the can adjacent to the opening of the can. It follows that the areas of the covering capsule corresponding to distal points are advantageously sealed to the edge of the can in a more adhesive and resistant manner than the areas of the covering capsule corresponding to points proximal to the edge adjacent to the opening of the can, thus allowing for greater tearing resistance of the capsule in areas distant from the edge from which a user takes advantage of the contents of the can.

Thus feature remove the risk that a user could exert, due to inattention and/or distraction, a force clearly greater than that necessary for detachment of the capsule in the area proximal to the opening of the can and thus totally tear the capsule from the can, since the user feels a lower adhesion and resistance in those areas that he wants to discover and therefore it is more likely that he tends to apply a gentler force on the edge of the capsule, that is of an intensity slightly greater than that necessary for the detachment of the capsule in the area proximal to the opening.

Advantageously, the applied solution is also easy to apply to known state of art sealing heads, as it only needs to replace the springs with others of variable stiffness. Thus, it advantageously enables a known sealing head to be improved in a simple and cost-effective manner, thus making a capsule-sealing machine of the known type as mentioned above fully exploitable, convertible, and flexible for the purpose.

BRIEF DESCRIPTION OF THE DRAWINGS

Further purposes, features and advantages of the present invention will be clear from the following detailed description of a preferred form of application of the invention, provided for explanatory and non-limiting purposes only with a variant thereof by means of the appended figures, wherein.

DETAILED DESCRIPTION

Figure 1:
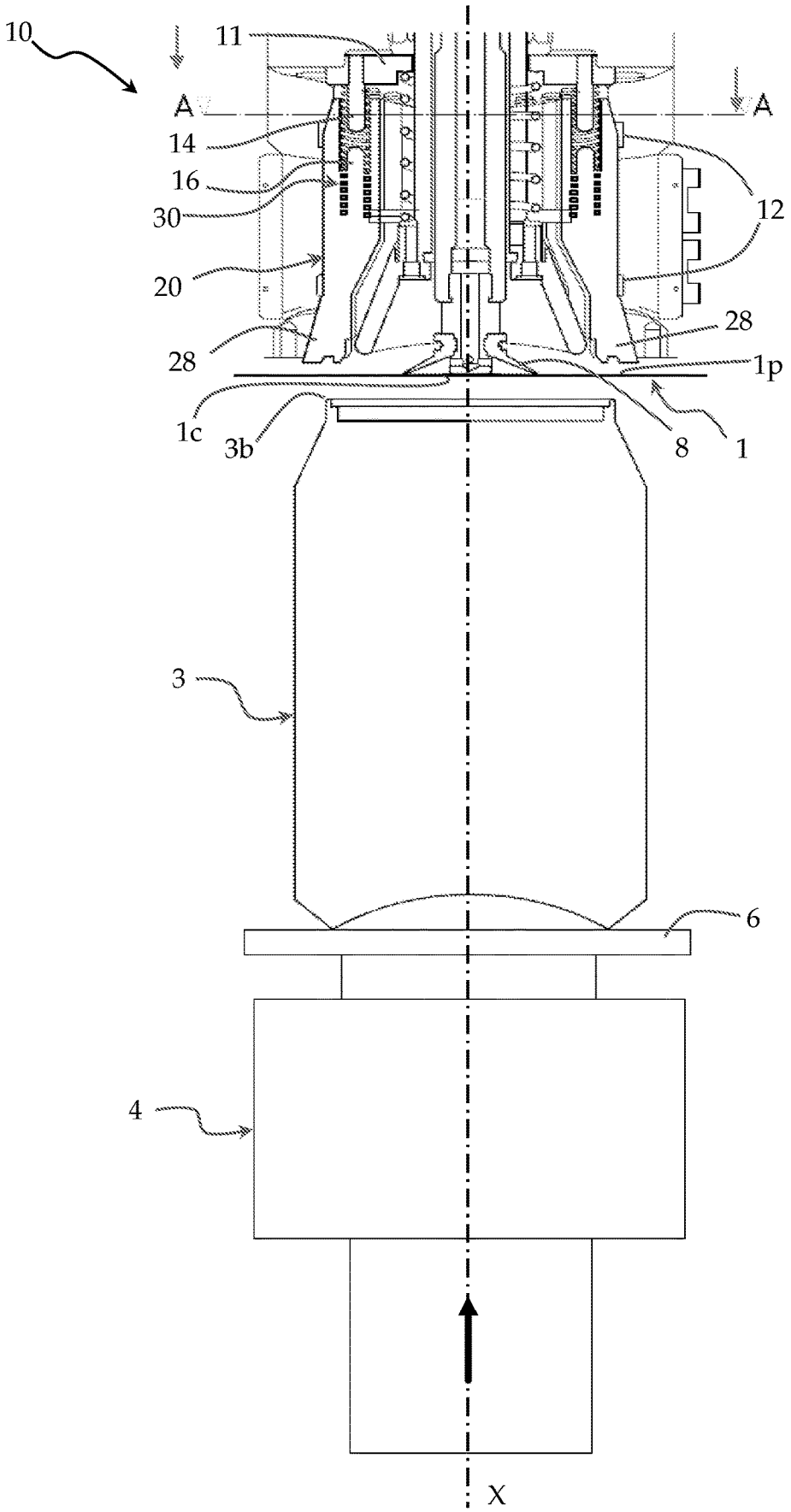
FIG. 1 represents a schematic upwards view of a longitudinally sectioned sealing head according to the invention and other parts of a capsule-sealing machine according to the invention, the machine depicted in a processing station thereof for capsule-sealing a can.
Figure 2:
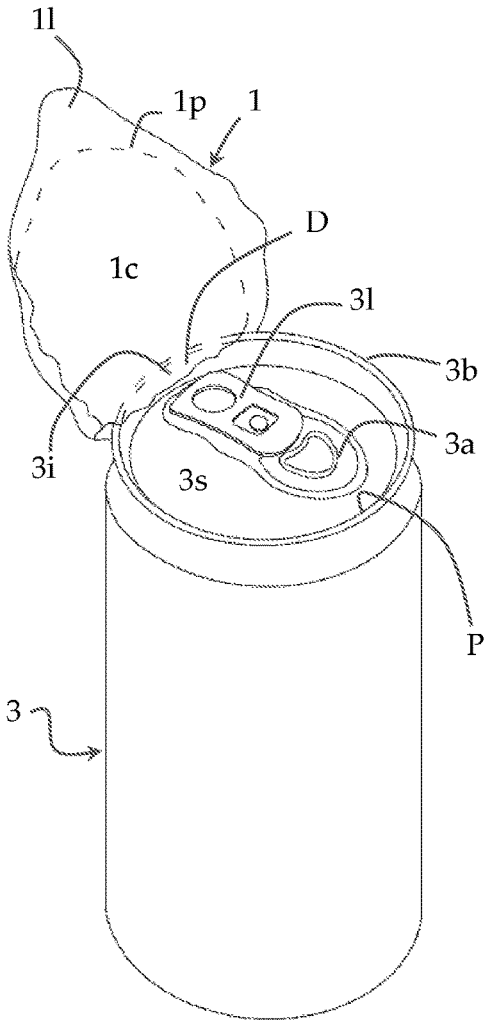
FIG. 2 represents a perspective view of a can obtained by processing the capsule-sealing machine of FIG. 1.

According to the above figures, a sealing head of a capsule-sealing machine for applying a covering capsule or capsule 1 to an upper surface 3*s* of a can 3 in a processing station of the same machine, as schematically illustrated in FIG. 1, is indicated by 10 in its entirety. The can 3 is of a type comprising an upper edge 3*b* and an opening 3*a* covered by tab 31 for dispensing the contents of the same can 3.

The sealing head 10 and the capsule-sealing machine are for example of a type as illustrated and described in patent application N. ITBO22020325, the description of which, in particular with regards to FIGS. 3 and 8 of the said document, is deemed to be incorporated in the present description for the sake of completeness.

More in detail, the sealing head 10 is of a type comprising:

- a plurality of circular sealing sectors, indicated in their entirety by 20, arranged around a vertical movement axis X of the same sealing head 10 and capable of interfering, through one of their conformed lower ends 28 and the interposed covering capsule 1, with a circumference 3*i* of the upper edge of the can 3*b* when the can 3 approaches the sealing head 10 during a processing phase in an capsule-sealing station of the capsule-sealing machine,
- elastic means, indicated by 30 in their entirety, in coupling with the circular sealing sectors 20 for the counteracted axial movement of the same circular sectors 20 when they come into contact with the covering capsule 1 and with the edge surrounding the can 3*i;*
- heating means, for example a pair of electrical resistors with a temperature sensing probe 12, connected to the circular sealing sectors 20 and suitable for bringing them to a given and fixed sealing temperature.

In the example, the elastic means comprise a plurality of helical springs 30 guided by first guide pins 14 integral with a central body 11 of the sealing head 10 and by second guide pins 16 integral with the circular sealing sectors 20. In this way, said circular sectors 20 are integral with the central body 11 and cannot rotate with respect to the same.

FIG. 1 schematically illustrates, omitting details not necessary for understanding the invention, the capsule-sealing machine in correspondence with one of its can capsule-sealing stations 3 with the relative covering capsule 1. Note how, in an operative condition of application of the covering capsule 1 on the same can 3, they are coaxially aligned to the vertical axis X, in order from bottom to top:

- a pusher 4 provided with a support surface 6 for the can 3 to be capsule-sealed;
- the can 3 to be capsule-sealed;
- the covering capsule 1, which is connected to a suction cup device 8 for its correct positioning to cover the surface of can 3*s* to be capsule-sealed,
- the sealing head 10 of the type described above.

Briefly, the operation of the capsule-sealing machine provides that, in the operating condition described above, the pusher 4 is driven to move from bottom to the top, in order to meet the can 3 with its supporting surface 6 and push the same upwards in the direction of the sealing head 10, with its upper surface 3*s* and relative upper edge 3*b* to meet the covering capsule 1 and then go to flow inside the sealing head 10, interfering with the circular sectors 20. The capsule 1 then adheres with one of its central parts 1*c* to the upper surface 3*s* by means of the suction cup 8, with its peripheral parts 1*p* to the conformed lower ends 28 of the circular sectors 20, which are heated to a certain sealing temperature by means of the heating means 12. When the edge of the can 3*b* with its surrounding 3*i* pushes the peripheral parts of the capsule 1 against the circular sectors 20, it meets the resistance of the elastic means 30 which thus exert a pressure force proportional to their stiffness on correspondent circumferential arc zones of edge 3*i*. Therefore, one of such zones, i.e. that corresponding to lower stiffness springs, shows a lower adhesion with the capsule and the other of such zones, namely that corresponding to higher stiffness springs, shows a higher adhesion with the capsule.

In this respect, the applicant has observed that it is possible to realize a sealing of the capsule 1 on the can 3 advantageously more or less strong and adhesive depending on their greater or lesser stiffness of the elastic means 30. This concept constitutes the focal point of the present invention.

Figure 3:
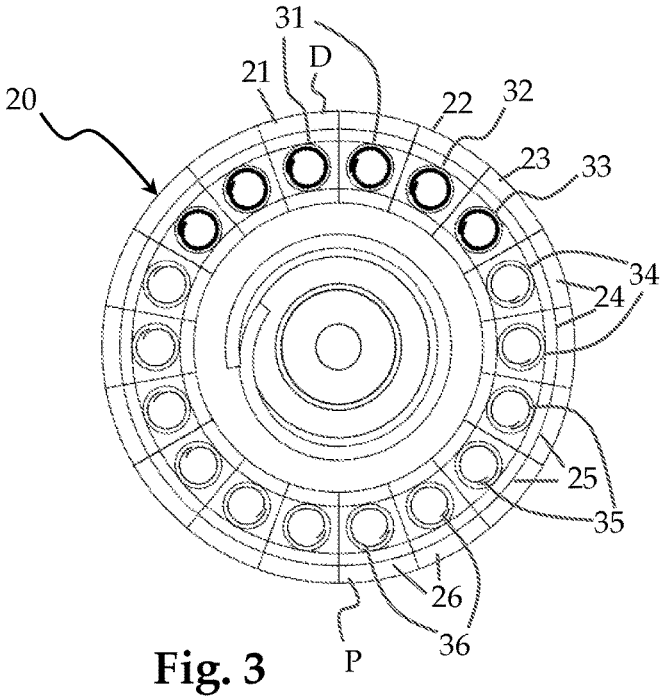
FIGS. 3 and 4 represent schematic views according to an A-A section of FIG. 1 respectively of some details of the sealing head of FIG. 1 and of a variant of the same head according to the invention.
Figure 4:
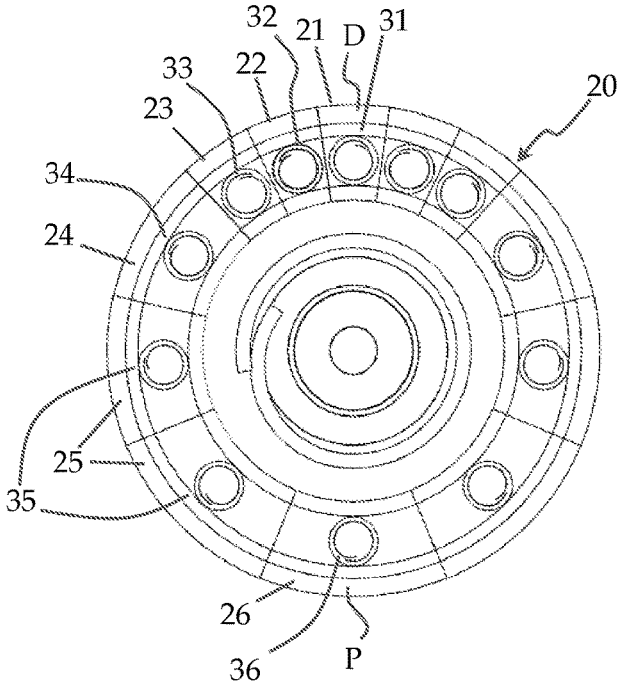

Therefore, a peculiarity of the invention is that the sealing head comprises elastic means with different stiffnesses, for example comprising of helical elastic springs with decreasing stiffness, in particular progressively decreasing from 31 to 36 when respectively coupled to the circular sectors 21-26 as illustrated in FIGS. 3 and 4, wherein 31 identifies the elastic spring with greater stiffness coupled to the circular sector 21 positioned in correspondence of a distal point D to an edge of the can adjacent to the opening 3*a*, in particular to the circular sector positioned in correspondence of the furthest point D from the edge of the can adjacent to the opening 3*i*. Preferably, the elastic spring with higher stiffness is located in an angular position other than that of a mean axis of the opening so that the latter is not facing the circular sector on which the spring with higher stiffness acts.

Advantageously, as already explained, the greater stiffness of the spring 31 means that the conformed lower end 28 of the circular sector 21 exerts a greater compression force when far from the edge of the can adjoining the opening 3*i*, thus realising a seal having greater strength and stiffness than that of the other points, distancing the danger of detachment of the covering capsule 1 when a user takes it by one of its flaps 11 proximal to the opening 3*a* in order to be able to open the can 3 and access its contents.

Elastic means, for example elastic springs 31-33 have higher stiffness when coupled to circular sectors 21-23 positioned at points distal D to an edge of the can adjoining the opening of the can 3*i*, lower stiffness springs 34-36 when coupled to circular sectors 24-26 positioned at points proximal P to the edge of the can adjoining the opening 3*i*. That is, one of the circular sectors 24-26 is facing the opening 3*i* and, for example, an axis of the corresponding lower stiffness spring is incident to a mean axis of the opening 3*i*.

With reference to a variant of the sealing head 10 as illustrated in the schematic section A-A of the FIG. 4, omitting some unnecessary details of the same, the circular sectors 21-23 positioned in correspondence of distal points (D) to the edge of the can adjacent to the opening 3*i* have a smaller circumferential extension compared to the circular sectors 24-26 positioned in correspondence of proximal points P to the edge of the can adjacent to the opening 3*i*, in particular they have a progressively smaller circumferential extension.

This advantageously increases the extension of areas of the sealing capsule with less stiffness and which offer less tearing resistance to a user, allowing the same to more easily detach the capsule 1 in those areas where there is access to the tab, together decreasing the extension of the areas having the sealing instead with greater stiffness thus considerably increasing the probability that the same capsule remains attached to the can.

It is clear that further and numerous variations are possible for a skilled person in the art of the capsule-sealing machine having an improved type of sealing head for applying an covering capsule to the top surfaces of cans and the associated improved sealing head and can having the associated covering capsule according to the invention; just as it is clear that in its practical implementation the shapes of the illustrated details may be different and the same may be replaced with technically equivalent elements.

For example, in a more sophisticated version of the sealing head, the variable stiffness spring means may comprise electronically controlled air springs, rather than other known types of mechanical spring that are equivalent to coil springs.

What is claimed is:

1. A sealing head of a capsule-sealing machine for applying a covering capsule on a top surface of a can to be encapsulated, the can comprising an edge and an opening covered by a tab for dispensing the contents of the can, the sealing head comprising:

first and second circular sealing sectors being radially positioned around an axis of vertical motion of the sealing head, at least one of the first and second circular sealing sectors being provided with a conformed lower edge, the conformed lower edge being operative to interpose between the covering capsule and a can edge proximal area as they approach together during the operation of the capsule-sealing machine;

first and second elastic means being coupled with said corresponding first and second sealing circular sectors for counteracting axial movement of the said circular sealing sectors as the covering capsule and the can edge proximal area approach together during operation of the capsule-sealing machine;

heating means being connected to said first and second circular sealing sectors, the heating means being operative to heat the first and second circular sealing sectors to a given sealing temperature;

wherein the sealing head is configured such that during the operation of the capsule-sealing machine, the first sealing circular sectors and the first elastic means are configured to apply a higher pressure on a first circumferential arc zone of the can, and the second sealing circular sectors with the second elastic means are configured to apply a lower pressure on a second circumferential arc zone of the can to achieve a differential adhesion between the covering capsule and the first and second circumferential arc zones on the first and second circumferential arc zones such that the capsule is separable from the second circumferential arc zone to open the can while remaining adherent to the first circumferential arc zone.

2. The sealing head according to claim 1, wherein the first and second circumferential arc zones are angularly arranged such that an opening of the can is facing said second circumferential area of the can.

3. The sealing head according to claim 1, wherein the first and second elastic means comprise springs, the first elastic means having a greater stiffness than the second elastic means, the first circular sealing sector being configured to align, during operation of the can-sealing machine, with a first can edge proximal area opposing the can opening, and with the second circular sealing sector being configured to align, during operation of the can-sealing machine, with a second can edge proximal area facing the can opening.

4. The sealing head according to claim 1, wherein the sealing head is incorporated within a capsule sealing machine for applying a covering capsule on a top surface of a can to be encapsulated, the capsule sealing machine additionally comprising a pusher having a support surface for supporting the can to be encapsulated, and a suction cup for holding the covering capsule.

* * * * *